US012044468B2

(12) United States Patent
Felbab

(10) Patent No.: US 12,044,468 B2
(45) Date of Patent: Jul. 23, 2024

(54) METHOD OF COOLING BOIL-OFF GAS AND APPARATUS THEREFOR

(71) Applicant: LGE IP Management Company Limited, Dunfermline (GB)

(72) Inventor: Nikola Felbab, London (GB)

(73) Assignee: LGE IP Management Company Limited, Dunfermline (GB)

( * ) Notice: Subject to any disclaimer, the term of this patent is extended or adjusted under 35 U.S.C. 154(b) by 300 days.

(21) Appl. No.: 17/635,110

(22) PCT Filed: Aug. 21, 2020

(86) PCT No.: PCT/GB2020/052017
§ 371 (c)(1),
(2) Date: Feb. 14, 2022

(87) PCT Pub. No.: WO2021/038205
PCT Pub. Date: Mar. 4, 2021

(65) Prior Publication Data

US 2022/0275998 A1 Sep. 1, 2022

(30) Foreign Application Priority Data

Aug. 23, 2019 (GB) ..... 1912126

(51) Int. Cl.
*F25J 1/00* (2006.01)
*F25J 1/02* (2006.01)

(52) U.S. Cl.
CPC ..... *F25J 1/0025* (2013.01); *F25J 1/0055* (2013.01); *F25J 1/0277* (2013.01); *F25J 2290/32* (2013.01)

(58) Field of Classification Search
CPC ..... F25J 2290/32; F25J 1/0277; F25J 1/0055; F25J 1/0025; F25J 1/0052
See application file for complete search history.

(56) References Cited

U.S. PATENT DOCUMENTS 5,724,832 A * 3/1998 Little ..... F25J 1/0279 62/48.2
6,330,811 B1 * 12/2001 Arman ..... C09K 5/045 62/84

(Continued)

FOREIGN PATENT DOCUMENTS

CN 101573575 A 11/2009
CN 202675795 U 1/2013

(Continued)

OTHER PUBLICATIONS

Heat Transfer Equipment for LNG, IP.com No. IPCOM000182746D, Published May 9, 2009.

(Continued)

*Primary Examiner* — Nelson J Nieves
(74) *Attorney, Agent, or Firm* — Flaster Greenberg P.C.

(57) ABSTRACT

A method of cooling a boil-off gas (BOG) stream from a liquefied gas tank comprising at least the step of heat exchanging the BOG stream with a first refrigerant in a heat exchanger, the heat exchanger having an entry port and a warmer exit port, and comprising at least the steps of: (a) passing the first refrigerant into the entry port of the heat exchanger and into a first zone of the heat exchanger to exchange heat with the BOG stream, to provide a first warmer refrigerant stream; (b) withdrawing the first warmer refrigerant stream from the heat exchanger at an intermediate exit port between the entry port and the warmer exit port; (c) passing the first warmer refrigerant stream through an entry port located in a second zone of the heat exchanger that is warmer than the first zone (d) passing an oil-containing refrigerant stream through an entry port located in a second zone of the heat exchanger that is warmer than the first zone; (e) mixing the first warmer refrigerant stream and the oil-containing stream in the heat-exchanger to form a com- (Continued)

bined refrigerant stream; and (f) passing the combined refrigerant stream out of the heat exchanger through the warmer exit port.

14 Claims, 5 Drawing Sheets

(56) References Cited

U.S. PATENT DOCUMENTS

| | | | | |
|---|---|---|---|---|
| 6,530,240 | B1 | 3/2003 | Kountz et al. | |
| 6,553,772 | B1 | 4/2003 | Belanger et al. | |
| 6,751,984 | B2 * | 6/2004 | Neeraas | F25J 1/0276 62/612 |
| 7,165,422 | B2 * | 1/2007 | Little | F25J 1/0225 62/51.1 |
| 8,806,891 | B2 | 8/2014 | Brendeng et al. | |
| 9,945,604 | B2 | 4/2018 | Ott et al. | |
| 10,107,549 | B2 | 10/2018 | Bonnissel et al. | |
| 10,422,558 | B2 | 9/2019 | Shimazu | |
| 10,655,911 | B2 * | 5/2020 | Turner | F25J 1/0204 |
| 11,561,042 | B2 * | 1/2023 | Felbab | F25J 1/0291 |
| 11,578,914 | B2 * | 2/2023 | Felbab | F25J 1/0055 |
| 2009/0008340 | A1 * | 1/2009 | Bauer | F25J 1/0262 210/767 |
| 2009/0260392 | A1 * | 10/2009 | Schmidt | F25J 1/0212 62/614 |
| 2010/0058802 | A1 | 3/2010 | Brendeng et al. | |
| 2010/0139316 | A1 | 6/2010 | An et al. | |
| 2010/0293996 | A1 | 11/2010 | Van Aken et al. | |
| 2011/0219819 | A1 * | 9/2011 | Bauer | F25J 1/0212 62/612 |
| 2014/0260415 | A1 | 9/2014 | Ducote, Jr. et al. | |
| 2015/0338161 | A1 * | 11/2015 | Park | F25J 1/0292 62/611 |
| 2016/0097589 | A1 * | 4/2016 | Turney | F25J 1/0052 62/613 |
| 2019/0072323 | A1 | 3/2019 | Felbab | |
| 2019/0097232 | A1 | 3/2019 | Felbab | |
| 2020/0041179 | A1 * | 2/2020 | Ducote, Jr. | F25J 1/0212 |
| 2020/0124346 | A1 | 4/2020 | Felbab | |
| 2022/0186986 | A1 * | 6/2022 | Kim | F25J 1/0262 |

FOREIGN PATENT DOCUMENTS

| | | | | |
|---|---|---|---|---|
| CN | 204678802 | U | 9/2015 | |
| CN | 204718299 | U | 10/2015 | |
| EP | 1092933 | A1 | 4/2001 | |
| EP | 1059494 | B1 | 5/2006 | |
| EP | 1959217 | A2 | 8/2008 | |
| EP | 2944902 | A2 | 11/2015 | |
| GB | 1323831 | | 7/1973 | |
| JP | H08-159652 | | 6/1996 | |
| JP | 2008-519242 | | 6/2008 | |
| WO | 2017144919 | A1 | 8/2017 | |
| WO | WO-2017144919 | A1 * | 8/2017 | F25J 1/0025 |
| WO | 2018193244 | A1 | 10/2018 | |

OTHER PUBLICATIONS

GB Search Report for GB applciation No. 1603403.5, mailed Aug. 31, 2016.

IRS and Written Opinion for PCT/GB2018/051012, mailed Jul. 4, 2018.

Small Scale Natural Gas Liquification Plants, P Neksa et al., XP-001543121, International Congress of Refrigeration 2007 (Beijing).

ISR and Written Opinion for PCT/GB2017/050510, mailed May 23, 2017 (Published as WO 2017/144919).

ISR and Written Opinion for corresponding PCT/GB2020/052017, mailed Nov. 9, 2020.

CN Office Action for CN 201780013219.7.

P. Neska, et al.; Development And Analysis Of A Natural Gas Reliquefaction Plant For Small Gas Carriers; Journal of Natural Gas Science, Feb. 2010, 143-149 (Jun. 4, 2010).

KR Application No. 10-2019-7034017; Office Action dated Sep. 8, 2022 (English translation).

World Scale Boil-Off Gas Reliquefaction, AICHE Spring National Meeting, Apr. 30, 2013, H. Bouer, et al. (XP-009195010).

Onboard Reliquification of LNG Boil-Off, 979 Trans. of Inst. of Marine Eng., vol. 02 (Jan. 1, 1980) No. 2, London, K. Witt (XP-001277355).

* cited by examiner

METHOD OF COOLING BOIL-OFF GAS AND APPARATUS THEREFOR

The present invention relates to a method of cooling a boil-off gas (BOG) stream from a liquefied gas tank, such as a cargo tank, such as on a floating vessel, using a refrigerant, such as a single mixed refrigerant (SMR), and apparatus therefor. It is particularly, but not exclusively, a method for cooling BOG from a floating LNG storage tank.

In cryogenic applications with multistream heat exchangers, such as plate-fin heat exchangers, a common feature is to inject a sidestream into the exchanger to merge with an internal stream in the exchanger. The combined stream then continues along the direction of the original internal stream prior to merging.

One possible application of this is in using a mixed-refrigerant cycle for reliquefying LNG boil-off gas. Traditionally, boil-off gas from liquefied natural gas (LNG) storage tanks on board ships carrying LNG as a cargo (typically LNG carriers) has been used in the ship engines to provide power to the ship. Any excess BOG is then considered 'waste gas', and is typically sent to a gas combustion unit (GCU), where it is disposed of by combustion.

However, ship engines have become increasingly more efficient, so that less of the BOG is required for the engines. This means a greater proportion of the BOG is sent to the GCU as waste gas. It is becoming economically attractive to reduce this loss of gas by re-liquefying it and returning it to the cargo tanks.

A standard method of re-liquefying LNG BOG uses a single mixed refrigerant (SMR) cycle, and an oil-injected screw compressor in the mixed refrigerant recirculating system. Oil-injected screw compressors are well proven in industry and cost-effective such that their use is preferred where possible. However, oil-injected screw compressors also have a certain degree of oil 'carryover' into the SMR during the compression, and exposure of the carryover oil to the lowest temperatures required in the LNG heat exchanger will solidify the oil and block up the LNG exchanger, leading to reduced performance, and ultimately system failure.

As such, the post-compression SMR must undergo at least one oil/gas separation step to provide a sufficiently 'oil-free' stream that can be expanded to a temperature that is below the 'oil-solidification' temperature, before use as the main cooling stream.

A conventional SMR cycle with an oil-injected screw compressor is shown in the accompanying FIG. 1. Boil-off gas from cargo tanks is compressed in a compressor (not shown) and sent for cooling via pipeline 20. The compressed boil-off gas is first cooled in an aftercooler 14 using a readily available ambient cooling medium (e.g. seawater, freshwater, engine room cooling water, air), after which it is cooled further in heat exchanger 12. This pre-cooled BOG is sent into multi-stream (i.e. more than just two streams) heat exchanger 7 (typically a brazed aluminium plate-fin heat exchanger), where it is cooled and condensed using an SMR recirculating system.

The heat exchanger 12 uses a refrigerant (typically propane) supplied via pipeline 32 and provided from a separate refrigerant cascade 13.

In the SMR recirculating system, the mixed refrigerant gas from refrigerant receiver 1 flows through a pipeline 22 to an oil-injected screw compressor 2. The SMR gas is compressed into pipeline 23, after which it enters an oil separator 3, where most of the oil is removed (by gravity and/or filtration) as an oil-based stream 25 and pumped by oil pump 4, cooled by oil cooler 5, and finally re-injected into compressor 2.

The gas from oil separator 3 is sent into pipeline 24. The gas in this pipeline is mostly oil-free, but does contain a small proportion (down to parts per million by weight) of oil. The gas in pipeline 24 is sent into an aftercooler 6 which uses a readily available cooling medium (e.g. seawater, freshwater, engine room cooling water, air).

Downstream of the aftercooler 6, condensation of the refrigerant gas is performed using heat exchange against a cold external refrigerant (typically propane) in condenser 11. The cold temperatures of this external refrigerant are created in the external refrigerant cascade 13. The refrigerant in pipeline 24 is at least partly condensed after passing through condenser 11, after which it enters a vapour—liquid separator 8 to provide vapour and liquid phases. A significant feature of the condensation in the condenser 11 and the separation (generally by gravity and optionally filtration), in a separator 8 (optionally having an integral or separate filter), is that the oil carried over after the separator 3 is now effectively all in the liquid phase, going into pipeline 29, leaving an essentially oil-free vapour in pipeline 26.

The 'liquid and oil' or oil-containing refrigerant in pipeline 29 has its pressure reduced by flash valve 9, leading to partial vaporisation and temperature reduction. This temperature is not low enough to cause solidification (waxing or freezing) of the oil. The partially vaporised refrigerant liquid and oil stream 42 is then sent into the multi-stream exchanger 7, where it is fully vaporised, thereby providing partial cooling to the hot streams in the exchanger 7. Meanwhile, the oil-free refrigerant vapour in pipeline 26 is sent into exchanger 7, where it is cooled substantially. It leaves the exchanger 7, fully or partly condensed, in pipeline 27, after which its pressure is reduced by a throttling valve 10 into pipeline 34 to its lowest temperature in the SMR recirculating system to achieve the required cooling in the exchanger 7. This provides the main cold stream for the exchanger 7. It is because the temperature of the refrigerant in pipeline 34 will be below the solidification temperature of the oil that it is necessary to remove as much of the oil as possible using exchanger 11 and separator 8 prior to pipeline 27.

The cold refrigerant in pipeline 34 is sent into exchanger 7, where it vaporises, cooling the hot streams. It merges with the partially vaporised liquid and oil stream 42, and the combined refrigerant stream 44 leaves exchanger 7 as a vapour via pipeline 28, to re-enter refrigerant receiver 1.

Overall, the cooling duty for the re-liquefaction process in the conventional SMR cycle shown in FIG. 1 is provided by both the SMR recirculating system and the external refrigerant cascade 13.

One potential issue is the merging in the exchanger 7 of the partially vaporised refrigerant liquid and oil stream 42 from the separator 8 with the refrigerant passing upwardly from pipeline 34. The liquid and oil stream 42 naturally has a higher, typically much higher, amount of oil compared with the stream in pipelines 26 and 34, which would quickly cause clogging in the exchanger 7 if it were to freeze.

Hence the merging of these streams is designed to occur at a sufficiently warm part of the exchanger 7 that is above the condensation temperature of the oil.

Meanwhile, the refrigerant passing upwardly from pipeline 34 is heated as it passes upwards through the exchanger 7 (by the various hotter streams in the exchanger 7 resulting in an increase in temperature and/or vapour fraction), so that it should have sufficient upward velocity in the exchanger 7 at the point of merger to ensure that the oil contained in the combined stream 44 is carried upwards and out of the exchanger 7.

However, if the heat exchanger 7 is not operating at design conditions (for example, due to being operated at part-load, or an external process disturbance, or being shut down), it is possible that the velocity of the combined stream 44 still in the heat exchanger 7 will be lower than the terminal velocity of the oil particles introduced in the partially vaporised refrigerant liquid and oil stream 42. This would cause oil particles to fall towards the cooler part of the heat exchanger 7 below the point of merger, where they would freeze and rapidly clog up the exchanger 7.

It is an object to the present invention to provide an improved process and apparatus merging such oil-containing streams during cooling of a BOG stream.

Thus, according to the first aspect of the present invention, there is provided a method of cooling a boil-off gas (BOG) stream from a liquefied gas tank comprising at least the step of heat exchanging the BOG stream with a first refrigerant in a heat exchanger, the heat exchanger having an entry port and a warmer exit port, and comprising at least the steps of:

(a) passing the first refrigerant into the entry port of the heat exchanger and into a first zone of the heat exchanger to exchange heat with the BOG stream, to provide a first warmer refrigerant stream;
(b) withdrawing the first warmer refrigerant stream from the heat exchanger at an intermediate exit port between the entry port and the warmer exit port;
(c) passing the first warmer refrigerant stream through an entry port located in a second zone of the heat exchanger that is warmer than the first zone
(d) passing an oil-containing refrigerant stream through an entry port located in a second zone of the heat exchanger that is warmer than the first zone;
(e) mixing the first warmer refrigerant stream and the oil-containing stream in the heat-exchanger to form a combined refrigerant stream; and
(f) passing the combined refrigerant stream out of the heat exchanger through the warmer exit port.

Liquefied gas tanks are well known in the art. All liquefied gas tanks create or release boil-off gas for known reasons, including tanks on liquefied gas carriers, barges and other vessels including transportation vessels. Liquefied gases can include those having normal boiling points (at 1 atm) below 0° C., typically at least below −40° C., such as various petroleum or petrochemical gases, and including liquefied natural gas (LNG) having a normal boiling point below −160° C.

Optionally, the BOG is from a liquefied cargo tank in a floating vessel, optionally an LNG cargo tank.

Many systems, apparatus and processes are known for cooling a boil-off gas (BOG) stream from a liquefied gas tank, usually for the re-liquefaction of BOG, using various single, mixed and multiple refrigerants, which may involve one or more circuits, heat exchangers and other variations of the cooling processes, typically to minimise the energy input required, typically with other constraints such as space, etc. The skilled person is aware of many such systems.

Many such systems involve at least one refrigerant compressor, often involving a lubricant. A common lubricant is oil. Oil-injected screw compressors are well proven in industry and cost-effective such that their use is preferred where possible. However, oil-injected screw compressors also have a certain degree of oil 'carryover' into the refrigerant during compression, and exposure of the carryover oil to the lowest temperatures required in some heat exchangers will solidify the oil and block up the heat exchanger, leading to reduced performance, and ultimately system failure.

The term "oil-containing stream" as used herein comprises a stream having oil in the refrigerant stream that has passed through an oil-injected screw compressor. Such oil is typically wholly or substantially the compressor lubricating oil. The term "oil-based stream" as used herein relates to a stream having a greater, generally a significant, amount of oil in the refrigerant stream, for example a liquid separated stream from a refrigerant stream that has passed through an oil-injected screw compressor. The term "oil-containing stream" is typically used herein to refer to a stream having less oil therein than an oil-based stream.

The heat exchanger of the present invention may be the only heat exchanger required to effect the required cooling of a boil-off gas (BOG) stream from a liquefied gas tank, or may be part of a larger or more extensive liquefaction heat exchanger system that comprises multiple heat exchanger units. Any reference herein to a "liquefaction heat exchanger system" implies that such liquefaction heat exchanger system includes the heat exchanger of the present invention.

One method of re-liquefying BOG uses a single mixed refrigerant (SMR) cycle, and an oil-injected screw compressor in the mixed refrigerant recirculating system. SMR is a term in the art used to refer to a range of refrigerants generally comprising a mixture of one or more hydrocarbons, in particular usually methane, ethane and propane, and possibly also at least butane, and nitrogen, optionally with one or more other possible refrigerants such as pentane. Various components and their ratios are known for forming a particular SMR, and are not further described herein.

Thus, according to one embodiment of the present invention, the first refrigerant is a single mixed refrigerant (SMR) or a portion of a single mixed refrigerant.

The SMR could be provided in an SMR recirculating system comprising at least the steps of:

(a) compressing the SMR using at least one oil-injected screw compressor to provide a post-compression SMR stream;
(b) separating the post-compression SMR stream to provide an oil-based stream and a first SMR vapour stream;
(c) passing the first SMR vapour stream into the liquefaction heat exchanger to provide a condensed SMR stream; and
(d) expanding the condensed SMR stream to provide an expanded lowest-temperature SMR stream to pass through the liquefaction heat exchanger system for heat exchange against the BOG stream.

Separating one or more of the streams as defined herein can be carried out in any suitable separator, many of which are known in the art, and which are generally intended to provide at least one gaseous stream, typically a lighter stream available at or near an upper part of the separator, and a heavier stream, typically comprising at least one liquid phase, typically available at a lower end of the separator.

Expansion of a stream is possible through one or more suitable expansion devices, generally including valves and the like.

The term "ambient cooling" as used herein relates to the use of an ambient cooling medium, usually provided at an ambient temperature. This includes seawater, freshwater, engine room cooling water, and air, and any combination thereof, which are typically easily available for use in providing ambient cooling to a stream.

It is possible that the compression of a refrigerant comprises the use of more than one compressor, optionally in parallel or series or both, to provide a post-compression stream.

The cooling of the boil-off gas (BOG) stream may be part of a liquefaction heat exchanger system, which may be any form of one or more heat exchangers arranged in one or more units or stages, and able to allow heat exchange between two or more streams, and optionally having at least one stream running countercurrently to one or more other streams in a part or portion of the system, in particular between the BOG stream and one of the refrigerant streams.

Where the liquefaction heat exchanger system comprises more than one heat exchanger, the more than one heat exchangers may be in series or in parallel or a combination of in series and in parallel, and the more than one heat exchangers may be separate or conjoined or contiguous, optionally in a single cooled unit or box, and optionally in the form of one or more units or stages of providing the required heat exchange with the BOG stream to liquefy the BOG stream.

The liquefaction heat exchanger system may comprise any suitable arrangement of two-stream or multi-stream heat exchangers arranged into one or more connected sections, units or stages, optionally with one section, unit or stage being 'warmer' than another section, unit or stage, in the sense of the average temperature therein.

Optionally, the heat exchanger of the present invention is a single liquefaction heat exchanger in a BOG liquefaction heat exchanger system. The heat-exchanger is a multi-stream heat exchanger to liquefied the BOG from one entry port to one exit port in one heat exchanger.

Optionally, the heat exchanger of the present invention is a liquefaction heat exchanger system, comprising a multi-unit liquefaction heat exchange, comprising two, optionally more than two, heat exchanger units, and the BOG stream and the first refrigerant passes through at least the coldest of the heat exchanger units.

Many liquefaction heat exchangers are known in the art which are able to be part of or provide the liquefaction heat exchanger system, typically comprising plate-fin, shell & tube, plate & frame, shell & plate, coil wound, and printed circuit heat exchangers, or any combination thereof.

Optionally, the heat exchanger in the present invention comprises a plate-fin heat exchanger or a printed circuit heat exchanger.

Optionally, the heat exchanger in the present invention is a vertical or near vertical or inclined heat exchanger.

Heat exchangers generally have one or more entry points or ports for a stream or streams, and one or more exit points or ports for a stream or streams, with a temperature gradient or gradient pathway thereinbetween. Most streams passing through a heat exchanger pass typically through 'all' of the heat exchanger, that is from an entry point or port at one end or side of the heat exchanger to an exit point or port, optionally at another end or side but not limited thereto, so as to achieve the maximum heat exchange possible between the entry and exit, i.e. the maximum temperature change or phase change possible along the temperature gradient pathway. Such streams have 'fully' or 'wholly' passed through the heat exchanger.

Some streams may only pass through a partial portion or amount of a heat exchanger, generally by either having an entry point or port at an intermediate temperature or location along the maximum possible temperature gradient pathway, or by having an exit point or port at an intermediate temperature along the temperature gradient pathway, or both. Such streams have passed through only part of the heat exchanger, and are typically referred to as 'side streams'.

Where the liquefaction heat exchange is provided by more than one liquefaction heat exchanger units and/or stages, optionally the first refrigerant stream passes into a first unit and/or stage, and the oil-containing refrigerant stream passes into a second unit and/or stage.

Optionally, the method of the present invention further comprises recycling the combined refrigerant stream after the heat exchanger for further cooling duty.

Optionally, the method of the present invention further comprises the step of expanding the first refrigerant prior to step (a) of the first aspect of the present invention.

Optionally, the temperature of step (e) of the first aspect of the present invention is higher than the temperature of the first zone in the heat exchanger. Further optionally, the temperature of the second zone is warmer than the oil condensation temperature of the oil of the oil-containing refrigerant.

Optionally, the intermediate exit port is within the second zone of the heat exchanger that is warmer than the first zone.

In one particular embodiment of the present invention, there is provided an SMR recirculating system for use with a method of cooling a boil-off gas (BOG) stream from a liquefied gas tank using a single mixed refrigerant (SMR) comprising at least the step of heat exchanging the BOG stream with the SMR in a liquefaction heat exchanger system to provide a cooled BOG stream, wherein the SMR is provided in an SMR recirculating system comprising at least the steps of:

(a) compressing the SMR using at least one oil-injected screw compressor to provide a post-compression SMR stream;

(b) separating the post-compression SMR stream to provide an oil-based stream and a first SMR vapour stream;

(c) separating the first SMR vapour stream to provide an oil-containing liquid-phase SMR stream and a SMR vapour stream;

(d) passing the SMR vapour stream through the liquefaction heat exchanger system to provide a condensed SMR stream;

(e) expanding the condensed SMR stream to provide an expanded lowest-temperature SMR stream to pass into a first zone of the liquefaction heat exchanger system for heat exchange against the BOG stream, and to provide a warmer SMR stream;

(f) withdrawing the warmer SMR stream from the heat exchanger at an intermediate exit port;

(g) passing the first warmer SMR stream through an entry port located in a second zone of the heat exchanger that is warmer than the first zone;

(h) passing the oil-containing liquid-phase SMR stream through an entry port located in a second zone of the heat exchanger that is warmer than the first zone;

(i) mixing the first warmer refrigerant stream and the oil-containing liquid-phase SMR stream in the heat-exchanger to form the combined refrigerant stream; and (j) passing the combined refrigerant stream out of the heat exchanger through the warmer exit port.

Optionally, separating the first SMR vapour stream (to provide an oil-containing liquid-phase SMR stream and a SMR vapour stream) can occur after some cooling of the first SMR stream vapour stream in the liquefaction heat exchanger.

Thus, according to another particular embodiment of the present invention, there is provided a method of cooling a boil-off gas (BOG) stream from a liquefied gas tank using a single mixed refrigerant (SMR) comprising at least the step of heat exchanging the BOG stream with the SMR in a liquefaction heat exchanger system to provide a cooled BOG stream, wherein the SMR is provided in an SMR recirculating system comprising at least the steps of:

(a) compressing the SMR using at least one oil-injected screw compressor to provide a post-compression SMR stream;

(b) separating the post-compression SMR stream to provide an oil-based stream and a first SMR vapour stream;

(c) passing the first SMR vapour stream into the liquefaction heat exchanger system to cool the first SMR vapour stream and provide a cooled first SMR vapour stream;

(d) withdrawing the cooled first SMR vapour stream from the liquefaction heat exchanger system;

(e) separating the cooled first SMR vapour stream to provide an oil-containing liquid-phase SMR stream and an oil-free SMR vapour stream;

(f) passing the oil-free SMR vapour stream through the liquefaction heat exchanger system to provide a condensed SMR stream;

(g) expanding the condensed SMR stream to provide an expanded lowest-temperature SMR stream to pass through the liquefaction heat exchanger system for heat exchange against the BOG stream, and to provide a warmer SMR stream;

(h) withdrawing the warmer SMR stream from the liquefaction heat exchanger system at an intermediate exit port;

(i) expanding the oil-containing liquid-phase SMR stream of step (e) to provide an at least partially expanded oil-containing refrigerant stream;

(j) passing the warmer SMR stream of step (h) and the at least partially expanded oil-containing refrigerant stream of step (i) into the liquefaction heat exchanger system through separate entry ports located in a second zone of the liquefaction heat exchanger system that is warmer than the first zone;

(k) combining the warmer SMR stream with the oil-containing refrigerant stream in the heat exchanger to provide a combined refrigerant stream;

(l) passing the combined refrigerant stream into the liquefaction heat exchanger system through an entry port located in a second zone of the liquefaction heat exchanger system that is warmer than the first zone; and (m) passing the combined refrigerant stream out of the liquefaction heat exchanger system through the warmer exit port.

Such a method is able to cool a BOG stream without an external refrigerant cascade. This method with a SMR recirculating system is able to provide all the sub-ambient refrigerant cooling duty for cooling a boil-off gas stream from a liquefied gas tank.

Optionally, where the liquefaction heat exchanger system is a single liquefaction heat exchanger, withdrawal of the cooled first SMR vapour stream from the liquefaction heat exchanger system in step (d) can occur at an intermediate temperature along the heat exchange occurring in the heat exchanger, optionally at a temperature that is similar to the entry for the oil-free SMR vapour stream into the liquefaction heat exchanger system to provide a condensed SMR stream. Thus, optionally, step (d) of this embodiment of the present invention comprises withdrawing the cooled first SMR vapour stream from the liquefaction heat exchanger system prior to the coldest part of the liquefaction heat exchanger system, i.e. achieving partial passageway through the liquefaction heat exchanger system.

The oil-free SMR vapour stream may be passed (back) into the liquefaction heat exchanger system at a temperature that is higher than, lower than, the same as, or similar to, the temperature of the withdrawn cooled first SMR vapour stream of step (d) of this embodiment of the present invention. Optionally, the oil-free SMR vapour stream passes into the liquefaction heat exchanger system at a temperature that is similar to the temperature of the withdrawn cooled first SMR vapour stream of step (d) of this embodiment of the present invention.

Alternatively, the liquefaction heat exchanger system of this embodiment of the present invention may be a multi-unit liquefaction heat exchange or heat exchanger, comprising two, optionally more than two, units, stages, systems or frames etc.

Where the liquefaction heat exchange of this embodiment of the present invention is provided by more than one liquefaction heat exchanger units, etc. optionally the first SMR vapour stream passes into a first unit, and the oil-free SMR vapour stream passes into a second unit. Alternatively optionally, the first SMR vapour stream passes into a first heat exchanger unit, etc., and the oil-free SMR vapour stream passes into both a first heat exchanger unit and a second heat exchanger unit. Alternatively optionally, the first SMR vapour stream is divided into two or more separate heat exchanger units, etc., and there are divided oil-free SMR vapour streams passing into the two or more separate heat exchanger units, etc. The skilled person can see that there can be further variants to the liquefaction heat exchanger system using a multi-unit liquefaction heat exchange arrangement, optionally also with division of the BOG stream being cooled.

Where the liquefaction heat exchange of this embodiment of the present invention is provided by more than one liquefaction heat exchanger units and/or stages, also optionally the first or warmer stage comprises either a multi-stream heat exchanger such as a plate-fin heat exchanger, or a series of distinct heat exchangers, optionally in series, in parallel, or both, at least one of which is able to cool the first SMR vapour stream and provide a cooled first SMR vapour stream prior to separating the cooled first SMR vapour stream to provide an oil-containing liquid-phase SMR stream and an oil-free SMR vapour stream.

According to a further aspect of the invention, there is provided apparatus for cooling a boil-off gas (BOG) stream from a liquefied gas tank comprising a refrigerant system as defined herein and a heat exchanger for heat exchange against the BOG stream.

According to a further aspect of the invention, there is provided a method of designing or integratively designing a vessel having a method of cooling a boil-off gas (BOG) stream from a liquefied gas tank as defined herein According to a further aspect of the invention, there is provided a method of designing or integratively designing a system for use with a method of cooling a boil-off gas (BOG) stream from a liquefied gas tank comprising the same or similar steps as described herein.

According to a still further aspect of the invention, there is provided a method of designing a process for cooling a boil-off gas (BOG) stream from a liquefied gas tank using a refrigerant, and comprising the same or similar steps as described herein.

According to a still further aspect of the invention, there is provided a method of designing a system for use with a method of cooling a boil-off gas (BOG) stream from a liquefied gas tank, and comprising the same or similar steps as described herein.

The designing methods as discussed herein may incorporate computer aided processes for incorporating the relevant operational equipment and controls into the overall vessel construction and may incorporate relevant cost, capacity of operation parameters into the methodology and design. The methods described herein may be encoded onto media that is suitable for being read and processed on a computer. For example, code to carry out the methods described herein may be encoded onto a magnetic or optical media which can be read by and copied to a personal or mainframe computer. The methods may then be carried out by a design engineer using such a personal or mainframe computer.

The present invention provides a convenient arrangement in cryogenic applications with multi-stream heat exchangers, especially a plate-fin heat exchanger, of merging a particular side stream with an upwards flowing internal stream outside the heat exchanger. The merged or combined stream can then continue along the direction of the original internal stream prior to the merger.

Optionally, the present invention relates to multi-stream heat exchangers where the main flow path direction in the exchanger is at least upward, typically vertical or inclined, so that the hot end of the heat exchanger is located physically above the cold end.

The process, positioning or arrangement of the combination or merging of the withdrawn warmer first refrigerant stream and the oil-containing stream may use any suitable arrangement within the heat exchanger, including but not limited to one or more merging pipes or pipelines, optionally spreading each stream across a number of pathways, and preferably able to provide an even or consistent merger across a number of pathways, such as may occur in a plate and fin heat exchanger for example.

Optionally, the merging of the warmer first refrigerant stream and the oil-containing stream may be physically higher (in relation to the orientation of the heat exchanger) than the withdrawal of the first warmer refrigerant stream from the heat exchanger, but the invention is not limited thereto.

Optionally, the entry of the oil-containing stream or the re-entry of the first warmer refrigerant stream, or of both said streams, into the heat exchanger may be near the location or at a different location to the withdrawal of the first warmer refrigerant stream, typically near to or adjacent to or in the location of the intermediate exit port, such that the return temperature of said stream or streams is the same or similar to the temperature of the warmer first refrigerant stream at the intermediate exit port.

The present invention includes the combining of one or more further streams with either or both of the first refrigerant streams and the oil-containing stream.

The present invention may involve a heat exchanger having more than two temperature zones. Typically, a heat exchanger involved in a method of cooling a BOG stream has a range of temperatures along its 'length', typically going from a 'cold/coldest/cool/cooler end', to a 'hot/hottest/warm/warmer/hotter end. Typically a heat exchanger has one or more temperature gradients along its length, such that there is not a distinct temperature boundary between one temperature zone and another temperature zone. The present invention is illustrated by the use of the accompanying FIGS. 2 and 3 using the terms "zone A" and "zone B", purely to illustrate the idea of a temperature point or line or boundary between an area in a heat exchanger able to freeze a typical oil from a compressor, and an area within which the temperature is above the freezing point of the oil. Any reference to 'a temperature' in an area or a zone is used herein to relate to the temperature at all points within that area or zone having the required or defined temperature, allowing for any temperature variance across the area or zone.

The skilled person is aware that different oils, including different refrigerant compressor lubricating oils, may have a different freezing point temperatures, such that the position of any part of a heat exchanger being lower than or above an oil freezing point is variable. However, any BOG liquefaction system will be built with one or more known refrigerant compressors using one or more known lubricating oils, such that the oil freezing point for the compressor of the particular refrigeration or liquefaction system will be pre-determined, to allow the manufacturer of the plant to pre-determine the location of the or each intermediate port to be formed in the heat exchanger.

Where the liquefaction heat exchanger system comprises multiple heat exchanger units, the present invention is not limited by the relative positioning of the first and second units, which may be contiguous or separate.

It is possible that the composition and/or ratio of components in any SMR stream used in the present invention can be varied to achieve best effect for each arrangement of the present invention.

Embodiments and an example of the present invention will now be described by way of example only and with reference to the accompanying schematic drawings in which:

Where relevant, the same reference numerals are used in different Figures to represent the same or similar feature.

FIG. 1 is a prior art arrangement described hereinabove, which requires an external refrigerant circuit and apparatus based on cascade 13 to achieve re-liquefaction of the compressed BOG using an SMR recirculating system and an oil-injected screw compressor 2.

Figure 1:
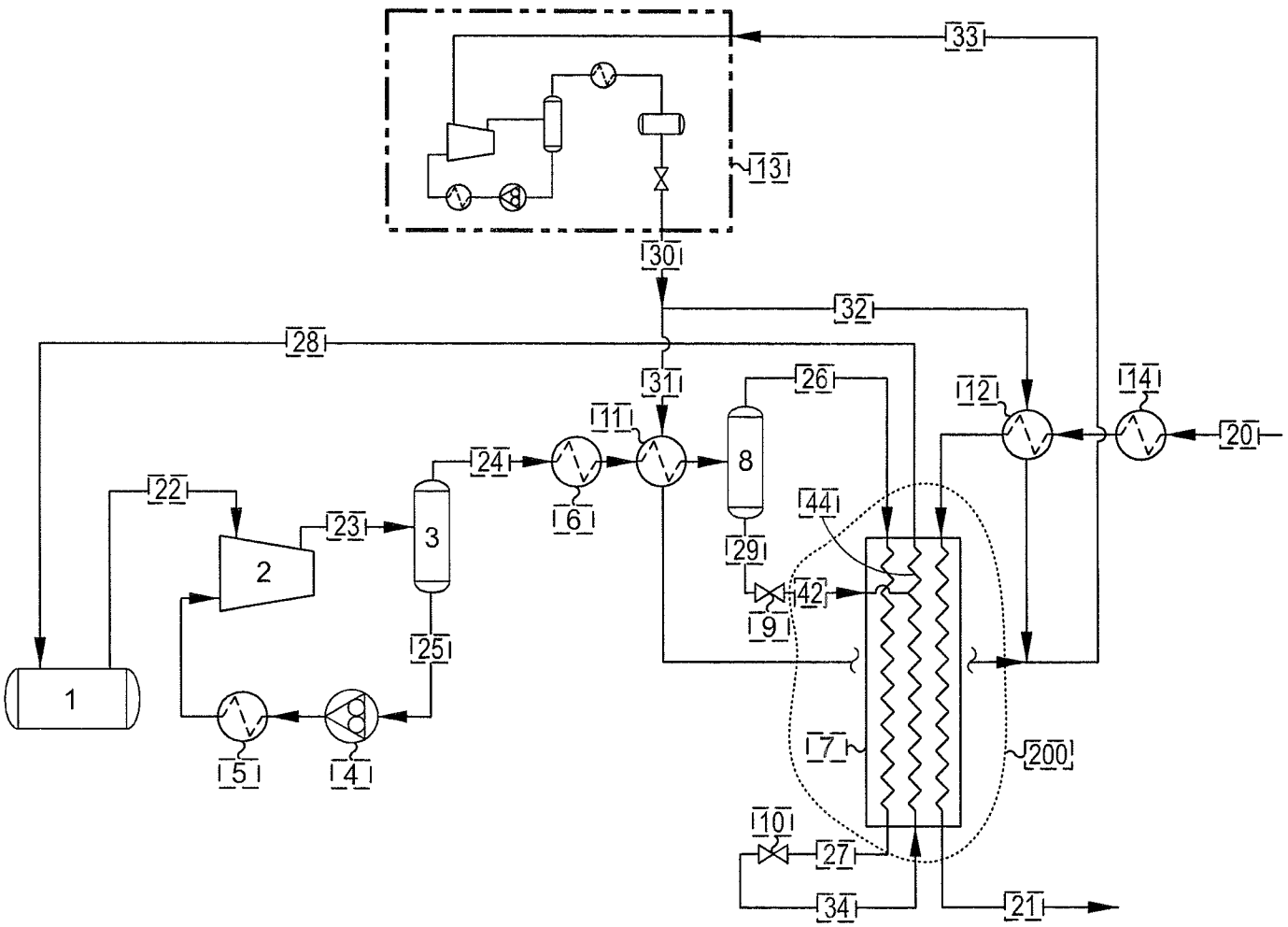
FIGURE 1 PRIOR ART
FIG. 1 is a schematic view of a prior art method of cooling a BOG stream using a prior art SMR system.
Figure 2:
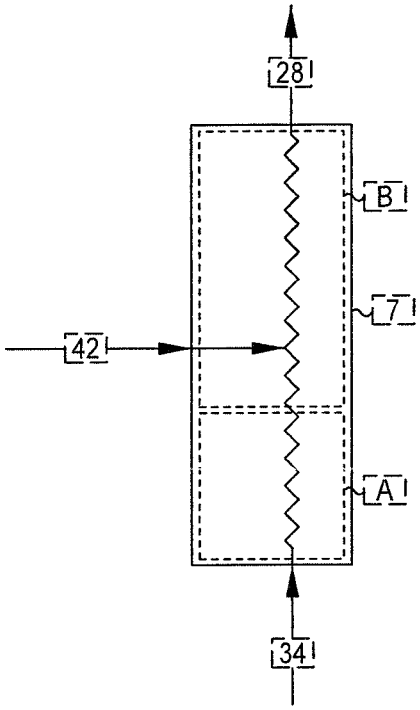
FIGURE 2 PRIOR ART
FIG. 2 is a simplified schematic view of Area 200 of FIG. 1.

FIG. 2 shows a simplified schematic view of Area 200 of FIG. 1, in which the first refrigerant stream 34 enters the exchanger 7 at its lowest temperature and into an area designated for illustration purposes only as a 'zone A', within which the temperature in the heat exchanger 7 is low enough that any compressor lubricating oil remaining in the stream 34 would freeze. However, stream 34 should not have sufficient oil content to cause a significant blockage or maloperation of the heat exchanger 7 by clogging.

This stream 34 is heated by the other hotter streams (such as the BOG stream in FIG. 1 from the exchanger 12, not shown) passing it in the exchanger 7, such that its enthalpy increases as it passes upwards through the exchanger 7, resulting in an increase in temperature and/or its vapour fraction.

At a warmer point in the exchanger 7 (i.e. within an illustrative warmer 'zone B'), and at a location physically higher than the cold stream inlet port, the expanded oil-containing stream 42 (usually having a sufficient oil content that would cause clogging of the exchanger 7 if it were to freeze) is injected into the exchanger 7, and merged with the warmer stream to create a combined stream 28 that continues along the path of the original cold stream mentioned above.

'Zone B' is sufficiently warm that oil in the injected stream 42 does not freeze. And if the arrangement shown in FIG. 2 is designed appropriately, there will be sufficient upwards velocity in the exchanger 7 at design conditions to ensure that any oil contained in stream 42 is always and only carried upwards in combined stream 28.

However, if the process is not operating at design conditions (for example, due to being operated at part-load, an external process disturbance, or being shut down), it is possible that the velocity of combined stream 28 will be lower than the terminal velocity of the oil particles introduced by oil-containing stream 42. Such an event would cause oil particles to fall down into 'zone A', where they would freeze and clog up the exchanger 7. This then requires shutting down the whole cooling process to access the heat exchanger 7 and physically or chemically remove the clogging oil and/or its solid components, causing unwanted delay and cost issues.

The present invention provides an alternative arrangement that avoids the abovementioned issue, by physically preventing the oil from being able to enter the coldest, typically the cryogenic, section of a heat exchanger.

Figure 3:
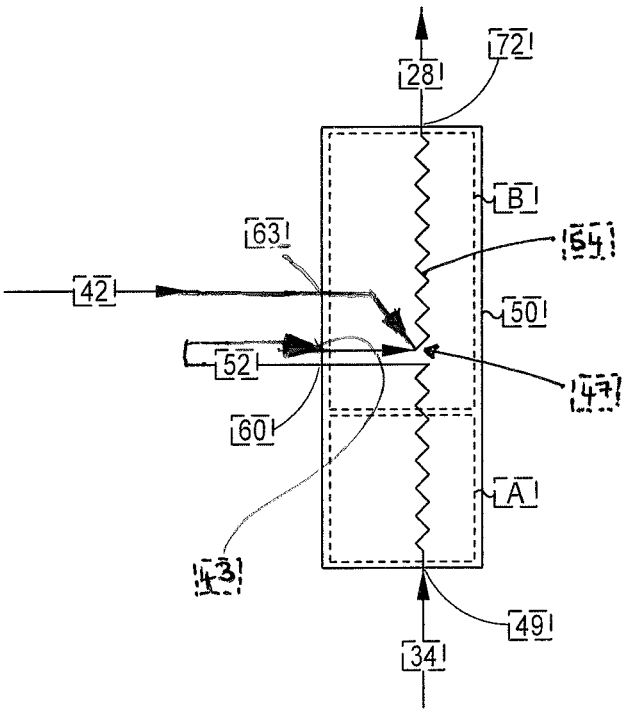
FIG. 3 is a simplified schematic view of part of a method of cooling a BOG stream using an embodiment of the present invention.

An illustration of the present invention is shown in FIG. 3. FIG. 3 shows the upwards-flowing first refrigerant stream 34 passing firstly into an illustrative temperature 'zone A' in a heat exchanger 50 through an entry port 49, then into an illustrative warmer temperature 'zone B', being withdrawn through an exit port 60 as a warmer refrigerant stream 52. The warmer refrigerant stream 52 is then passed back into the heat exchanger 50 via an entry port 43 in zone B.

Meanwhile, an oil-containing refrigerant stream 42 also enters the heat exchanger 50 via an entry port 63 in zone B, and then combined at a suitable junction point 47, being one or more pathways, so as to form a combined refrigerant stream 54. This combined stream 54 continues an upward flow, leaving the heat exchanger 50 through a warmer exit port 72 as a combined exit stream 28. Heat exchanger 50 is different from heat exchanger 7 in FIG. 2, in that heat exchanger 50 has the additional withdrawal port 60 to withdraw the first refrigerant stream 34.

In this way, should the flow of combined stream 54 within the heat exchanger 50 be too low, such that the stream's velocity is below that of the terminal velocity of the oil particles introduced in the oil-containing stream 42, the oil or oil particles cannot drop or fall down into 'zone A' of the heat exchanger 50, where it or they would freeze and cause issues and possible damage to the heat exchanger 50 as discussed above.

Compared to the arrangement in FIG. 2, the arrangement in FIG. 3 physically segregates the possible flow path of the oil from being able to enter the section of a heat exchanger where oil-freezing temperatures exist.

Figure 4:
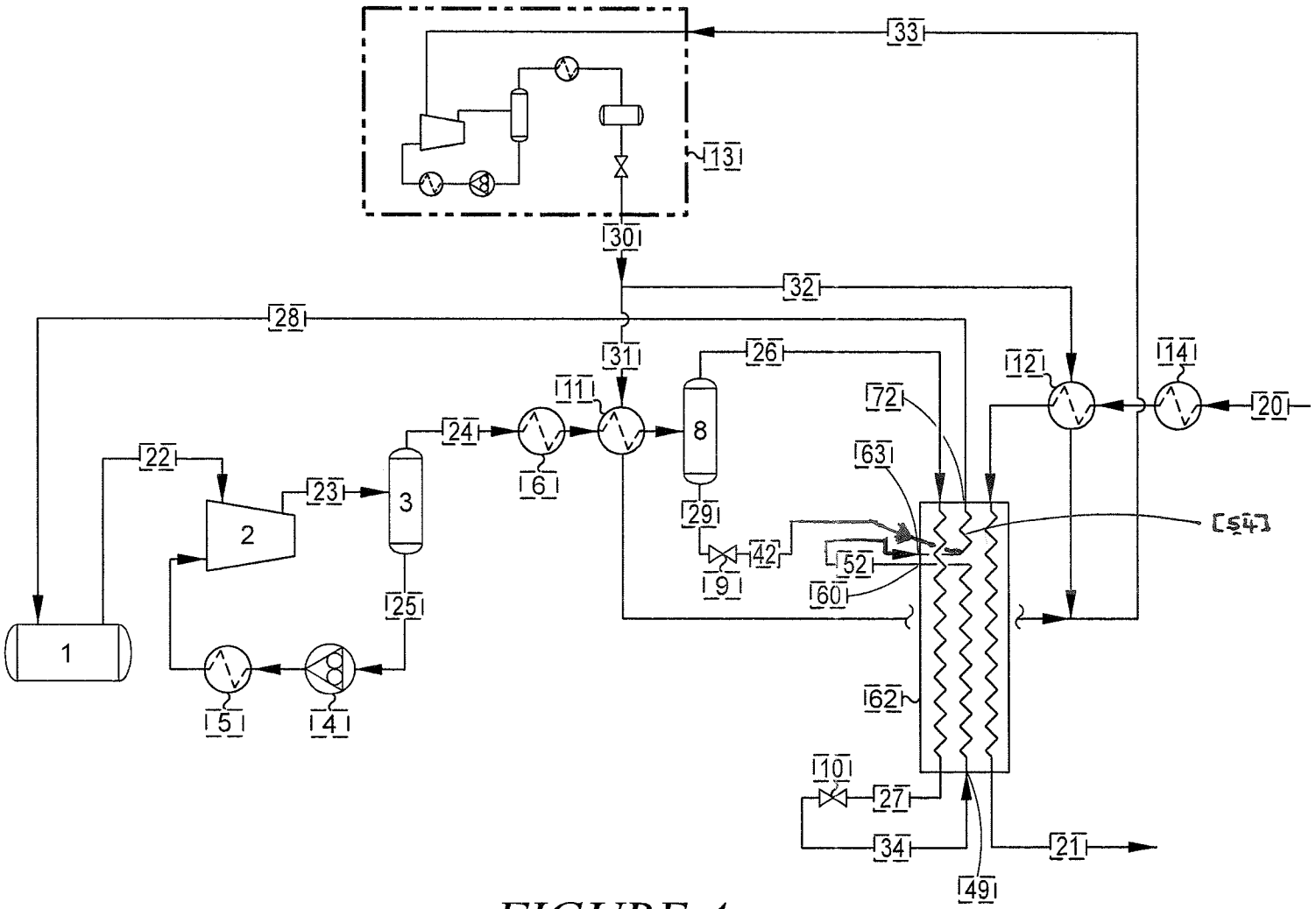
FIG. 4 is a schematic view of a method of cooling a BOG stream according to a first embodiment of the present invention.

FIG. 4 shows a method of cooling a boil-off gas stream from a liquefied gas tank according to a first general embodiment of the present invention, and using a single mixed refrigerant (SMR), and comprising at least the step of heat exchanging the BOG stream with the SMR in a liquefaction heat exchanger system to provide a cooled BOG stream, and wherein the SMR is provided in an SMR recirculating system.

In more detail, FIG. 4 shows a BOG stream 20 provided from one or more LNG cargo tanks (not shown) and already compressed in a compressor (also not shown). The BOG stream 20 is optionally ambient cooled in a first ambient heat exchanger 14, using a readily available cooling medium (e.g. seawater, freshwater, engine room cooling water, air) and/or a heat exchanger 12 using a partial stream 32 of the external refrigerant supplied via stream 30 from the refrigerant cascade 13. This optionally cooled (and compressed) BOG stream is then passed into a liquefaction heat exchanger system 62.

The liquefaction heat exchanger system 62 may comprise any form or arrangement of one or more heat exchangers able to allow heat exchange between two or more streams, optionally between multiple streams, and optionally having at least one stream running countercurrently to one or more other streams in a part or portion of the system, in particular between the BOG stream and one of the refrigerant. Any arrangement of more than one heat exchanger may be in series or in parallel or a combination of in series and in parallel, and the heat exchangers may be separate or conjoined or contiguous, optionally in a single cooled unit or box, and optionally in the form of one or more stages of providing the required heat exchange with the BOG stream to liquefy the BOG stream.

Liquefaction heat exchanger systems comprising more than one heat exchanger generally have a section, unit or stage being 'warmer' than another section, unit or stage, in the sense of the average temperature therein.

Some variants of suitable liquefaction heat exchanger systems are discussed and shown hereinafter. The skilled person can recognise other variants, and the invention is not limited thereby.

In the general liquefaction heat exchanger system 62 shown in FIG. 4, the cooled (and compressed) BOG stream is condensed by colder streams, and the condensed BOG stream leaves the exchanger system 62 via pipeline 21, and can be returned to the LNG cargo tanks.

In the SMR system, an initial stream of SMR refrigerant gas 22 from a refrigerant receiver 1 is sent to an oil-injected screw compressor 2. Oil-injected screw compressors are well known in the art, and not further described herein. Oil-injected screw compressors are well proven in industry and are cost-effective, especially for small scale or small volume compression, but are known to have the disadvantage that some, possibly even microscopic amounts, of the oil can become entrained in the gas passing through the compressor, and thus become a part of the gas discharge therefrom.

In FIG. 4, compressing the initial SMR stream 22 using the one oil-injected screw compressor 2 provides a post-compression SMR stream 23, which enters a first oil separator 3, optionally having a filter, which separates the post-compression SMR stream 23 to provide an oil-based stream 25 and a first SMR vapour stream 24. Most of the oil is removed in the separator 3 typically by gravity and/or filtration. The recovered oil-based stream 25 is drained into a pipeline where pressure differences or an optional oil pump 4 passes the oil to oil cooler 5 cools the oil, which is then re-injected as stream into compressor 2.

The first SMR vapour stream 24 is mostly oil-free, but does contain some degree of oil carryover. The first SMR vapour stream 24 is cooled in a second ambient heat exchanger 6 using a readily available cooling medium (e.g. seawater, freshwater, engine room cooling water, air), and further cooled in another cooler 11 using the separate circuit 13 to pass to separator 8. Separator 8 provides vapour stream 26, which passes into the liquefaction heat exchanger 62, as a first refrigerant, where the refrigerant is cooled and at least partially condensed.

Meanwhile, the vapour—liquid separator 8 provides a bottom liquid-phase SMR stream 29, generally comprising liquid and a residual oil amount. Thereafter, the pressure of the oil-containing liquid-phase SMR stream 29 can be reduced by a flash valve 9, resulting in some vaporisation and an associated reduction in temperature to provide an at least partly vaporised, liquid-phase oil-containing SMR stream 42.

In FIG. 4, the first refrigerant vapour stream 26 is cooled until it partly or wholly condenses, leaving the heat exchanger system 62 as a condensed SMR stream 27. Thereafter, the pressure is reduced via throttling valve 10, leading to partial vaporisation and temperature reduction to provide the expanded lowest-temperature SMR stream 34. The expanded lowest-temperature SMR stream 34 is the coldest SMR refrigerant stream in the SMR system, having a temperature below the oil-freezing or oil-solidification temperature of the oil in the oil-injected screw compressor 2.

The expanded lowest-temperature SMR stream 34 is sent back into heat exchanger 62 through entry port 49, where it vaporises as it heats up, and in doing so, cools the warmer streams in the heat exchanger system 62 to provide the majority of the cooling duty. The warmer SMR refrigerant stream can then be withdrawn through port 60 to provide warmer SMR refrigerant stream 52, which is then passed back into the heat exchanger 62 via an entry port 63. Meanwhile, the liquid-phase oil-containing SMR stream 42 also passes into the heat exchanger via a suitable and separate entry port (not shown), and then combined or merged with the warmer SMR refrigerant stream 52 at a suitable location or locations within the heat exchanger 62 to form a single or combined stream 54. The combined stream 54 continues its passage through and out of the heat exchanger system 62 through the warmer exit port 72, leaving as a post-cooling vapour stream 28, to be returned to refrigerant receiver 1.

Figure 5:
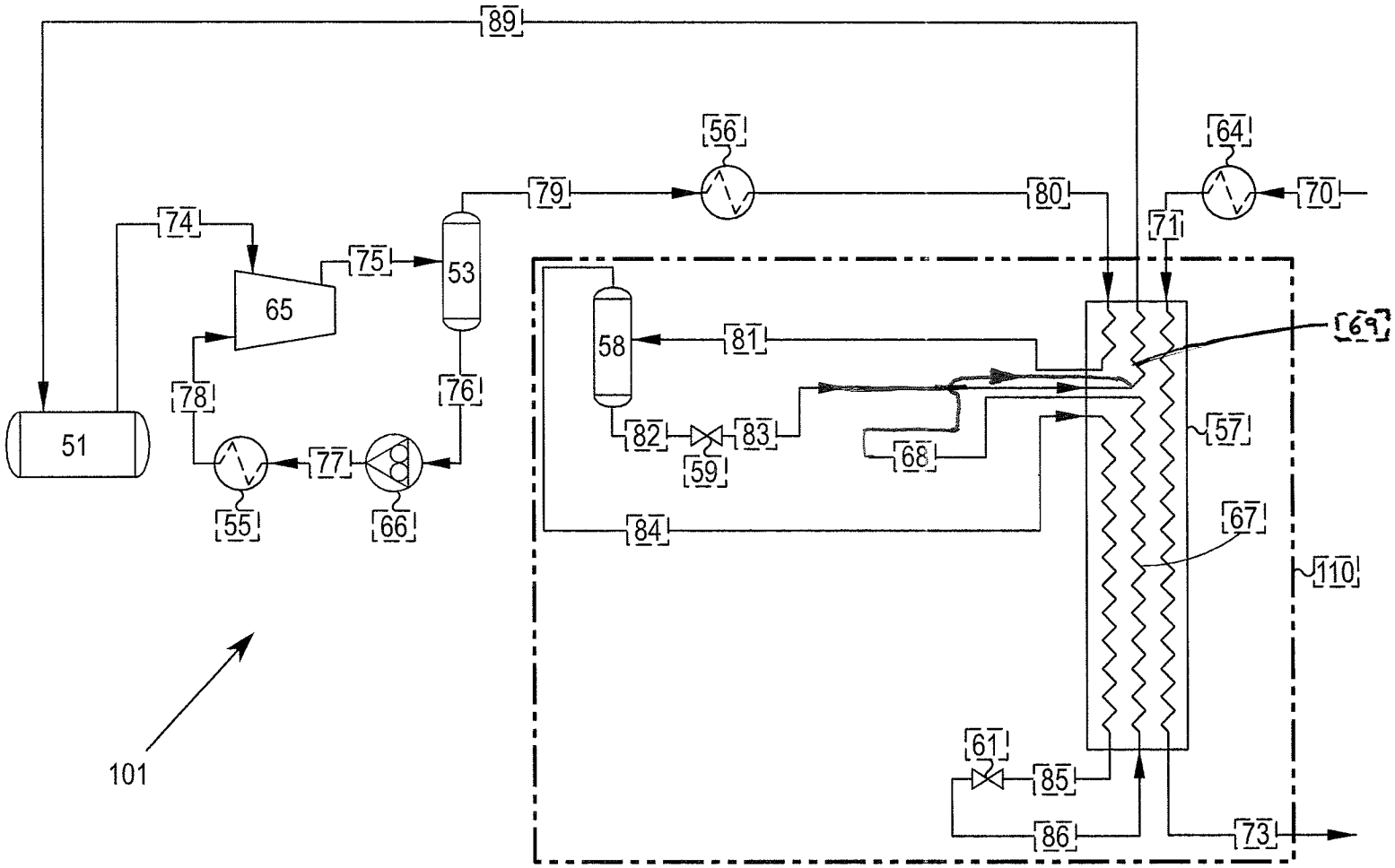
FIG. 5 is a schematic view of a method of cooling a BOG stream according to a second embodiment of the present invention.

FIG. 5 shows a method of cooling a boil-off gas stream from a liquefied gas tank according to a second general embodiment of the present invention, and using a single mixed refrigerant (SMR), and comprising at least the step of heat exchanging the BOG stream with the SMR in a liquefaction heat exchanger system to provide a cooled BOG stream, and wherein the SMR is provided in an SMR recirculating system. In comparison with FIG. 4, the method shown in FIG. 5 does not require an external cascade 13. For clarity purposes, not all of the entry and exit ports of the heat exchangers shown in FIGS. 4-7 have been specifically labelled.

FIG. 5 shows a BOG stream 70 provided from one or more LNG cargo tanks (not shown) and already compressed in a compressor (also not shown). The BOG stream 70 is optionally ambient cooled in a first ambient heat exchanger 64, using a readily available cooling medium (e.g. seawater, freshwater, engine room cooling water, air). This optionally cooled (and compressed) BOG stream 71 is then passed into a liquefaction heat exchanger system 57 (typically a brazed aluminium plate-fin heat exchanger), where the cooled (and compressed) BOG stream 71 is condensed by the colder streams discussed herein before in the SMR recirculating system 101, to leave the exchanger system 57 via pipeline 73, and optionally return back to the LNG cargo tanks.

In the SMR system 101, an initial stream of SMR refrigerant gas 74 from a refrigerant receiver 51 is sent to an oil-injected screw compressor 65. Oil can become entrained in the gas passing through the compressor, and thus become a part of the gas discharge therefrom.

In FIG. 5, compressing the initial SMR stream 74 using the one oil-injected screw compressor 65 provides a post-compression SMR stream 75, which enters an oil separator 53, optionally having a filter, which separates the post-compression SMR stream 75 to provide an oil-based stream 76 and a first SMR vapour stream 79. Most of the oil is removed in the separator 53 typically by gravity and/or filtration. The recovered oil-based stream 76 is drained into a pipeline where pressure differences or an optional oil pump 66 passes the oil to stream 77, and an oil cooler 55 cools the oil, which is then re-injected as stream 78 into compressor 65.

The first SMR vapour stream 79 is mostly oil-free, but does contain some degree of oil carryover. The first SMR vapour stream 79 is cooled in a second ambient heat exchanger 56 using a readily available cooling medium (e.g. seawater, freshwater, engine room cooling water, air) to provide a cooler first vapour stream 80. Depending on the composition and pressure of the refrigerant, as well as on the temperature achieved in the second ambient heat exchanger 56, some condensation of the SMR may start to occur.

The cooler first vapour stream 80 passes into the liquefaction heat exchanger system 57, where the refrigerant is cooled and at least partially condensed. The temperature to which it is cooled is higher than the solidification temperature of the oil. The cooled first SMR vapour stream 81 is withdrawn at an intermediate temperature along the liquefaction heat exchanger system 57, and enters a vapour—liquid separator 58. In the separator 58, an oil-containing liquid-phase SMR stream 82, generally comprising liquid and a residual oil amount, can be drained via as stream 82.

In the separator 58, an oil-free (or essentially oil-free) SMR vapour stream 84 is sent into the heat exchanger system 57. In FIG. 5, the oil-free SMR vapour stream 84 enters the heat exchanger system 57 at an intermediate temperature, optionally at a similar temperature to that at the withdrawal of the cooled first SMR vapour stream 81. In the heat exchanger system 57, this oil-free SMR vapour stream 84 is cooled until it partly or wholly condenses, leaving the heat exchanger system 57 as a condensed SMR stream 85. Thereafter, the pressure is reduced via throttling valve 61, leading to partial vaporisation and temperature reduction to provide the expanded lowest-temperature SMR stream 86. The expanded lowest-temperature SMR stream 86 is the coldest SMR refrigerant stream in the SMR system 101, having a temperature below the oil-solidification temperature of the oil in the oil-injected screw compressor 65.

The expanded lowest-temperature SMR stream 86 is sent back into heat exchanger system 57, where it becomes a warmer SMR refrigerant stream 67 as it heats up, and in doing so, cools the warmer streams in the heat exchanger system 57 to provide the majority of the cooling duty.

The warmer SMR refrigerant stream 67 can then be withdrawn through a suitable intermediate exit port to provide an external SMR stream 68, and then returned back into the heat exchanger 57 via a suitable entry port at or near the same level or location as the intermediate exit port.

Meanwhile, the pressure of the oil-containing liquid-phase SMR stream 82 can be reduced by a flash valve 59, resulting in some vaporisation and an associated reduction in temperature. The SMR system 101 is designed such that this lower temperature is still above the solidification temperature of the oil. The expanded stream 83 is passed into the heat exchanger 57 via a suitable inlet port, and then is merged with the returned SMR stream to form a single or combined stream 69 inside the heat exchanger 57. The combined stream 69 continues passage through and out of the heat exchanger system 57, leaving as a post-cooling vapour stream 89, to be returned to refrigerant receiver 51.

The liquefaction heat exchanger system shown in FIG. 5 may comprise any form or arrangement of one or more heat exchangers able to allow heat exchange between two or more streams, optionally between multiple streams, and optionally having at least one stream running countercurrently to one or more other streams in a part or portion of the system, in particular between the BOG stream and one of the refrigerant. Any arrangement of more than one heat exchanger may be in series or in parallel or a combination of in series and in parallel, and the heat exchangers may be separate or conjoined or contiguous, optionally in a single cooled unit or box, and optionally in the form of one or more stages of providing the required heat exchange with the BOG stream to liquefy the BOG stream.

Liquefaction heat exchanger systems comprising more than one heat exchanger generally have one section, unit or stage being 'warmer' than another section, unit or stage, in the sense of the average temperature therein.

Variants of suitable liquefaction heat exchanger systems are known, including the liquefaction heat exchanger system comprising two heat exchangers. The skilled person is aware of other variations possible within the scope of the present invention.

For example, in place of the single liquefaction heat exchanger system shown in FIG. 5, first and second parallel liquefaction heat exchanger systems could be used, each using the method of cooling a BOG stream as per the present invention, and possibly based on splitting either the cooler first vapour stream 80 or the expanded lowest-temperature SMR stream 86 in FIG. 5 or a similar stream, to form split streams for each of the heat exchangers. The first and second liquefaction heat exchanger systems could be the same or similar, i.e. having the same or similar size and/or capacity; but the present invention extends to the first and second liquefaction heat exchanger systems being different, such as having a different size or capacity.

The benefit of two heat exchanger systems allows the user to better accommodate the heat exchanger systems, especially within a confined or restricted space or spacing on a cargo vessel, and/or to help share the load, loading duty, cooling, cooling duty required, especially where there may be variation thereof due to variants in the amount or nature of the BOG stream to be reliquefied.

Figure 6:
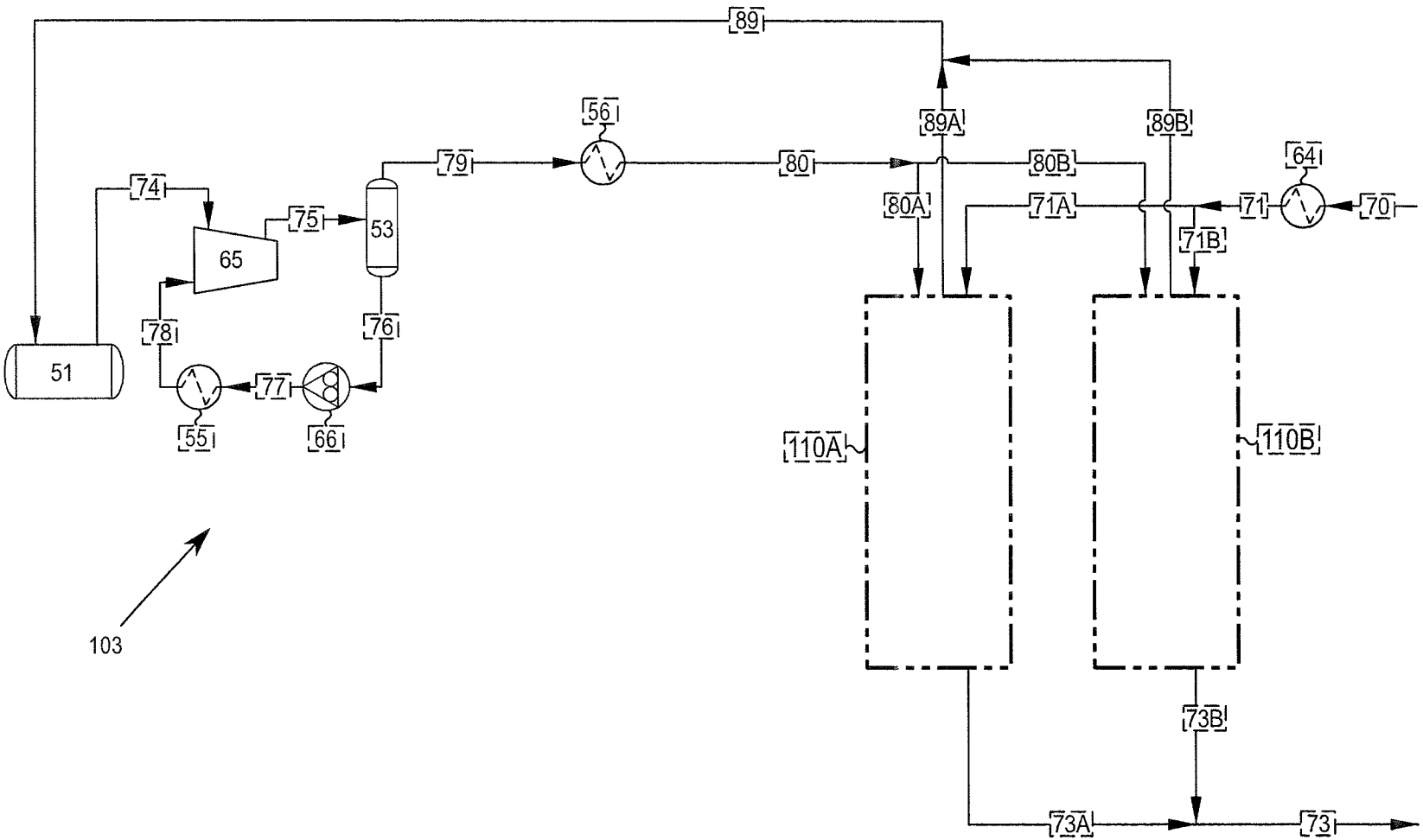
FIG. 6 is a schematic view of a method of cooling a BOG stream according to another embodiment of the present invention.

FIG. 6 shows a method of cooling a boil-off gas stream from a liquefied gas tank according to a another embodiment of the present invention, and using a single mixed refrigerant (SMR). FIG. 6 shows a BOG stream 70 provided from one or more LNG cargo tanks, and requiring reliquefaction in a manner described in relation to the first, second and third embodiments of the present invention described herein above.

FIG. 6 shows two liquefaction and separation systems 110A and 110B. Each system is based on the portion of FIG. 5 labelled 110, and encompassing the liquefaction heat exchanger system 57, the vapour-liquid separator 58, and the streams and pipelines associated therewith within the boundary of 110.

Thus, FIG. 6 represents the provision of two separate liquefaction and separation systems 110A and 110B.

FIG. 6 shows division of the cooler first vapour stream 80, and division of the optionally cooled and compressed BOG stream 71, into split BOG stream 71A and 71B, with each of the split streams entering into respective first and second liquefaction and separation systems 110A and 110B. FIG. 6 also shows the resultant liquefied BOG streams 73A and 73B being provided by the first and second liquefaction and separation systems 110A and 110B, which streams can then be combined into a single return BOG stream 73 as described above.

The temperatures and/or operations of each of the first and second liquefaction and separation systems 110A and 110B can be the same or different to that shown for the system 110 in FIG. 5. The embodiment of the present invention shown in FIG. 6 provides the user with the advantages described herein above, in particular the allowance of some variants in the positioning and/or location of the liquefaction and separation systems, and/or variants in the capacity of each of the liquefaction and separation systems 110A and 110B, typically due to variants in the supply of BOG to be reliquefied.

The skilled person can see that the present invention can be provided by the use of more than two units, stages, frames etc., such as the use of more than two liquefaction heat exchangers, more than two vapour-liquid separators, etc., so as to provide the most efficient overall method for cooling the BOG to be provided thereto, whilst only requiring the provision of one SMR refrigerant system.

The present invention is a modification of a refrigerant cycle for BOG cooling, and LNG re-liquefaction in particular, that allows the use of a cost-efficient oil-injected screw compressor in the refrigerant system. The present invention is also able to accommodate the possibility of different flows or flow rates of the first refrigerant stream and the oil-containing refrigerant stream, such that there is reduced or no concern by the user of the process in relation to possible oil freezing and clogging of the heat exchanger caused by variation of the flow or flow rate of the oil-containing refrigerant stream. Furthermore, the need to regularly carry out maintenance of heat exchangers to remove frozen oil, especially in parts of the heat exchanger which are typically the coldest, or at least operating at a temperature below the oil condensation point, is reduced or removed entirely.

The invention claimed is:

1. A method of cooling a boil-off gas (BOG) stream from a liquefied gas tank comprising at least the step of heat exchanging the BOG stream with a first refrigerant in a heat exchanger, the heat exchanger having an entry port and a warmer exit port, the method comprising the steps of:

(a) passing the first refrigerant into the entry port of the heat exchanger and into a first zone of the heat exchanger to exchange heat with the BOG stream and to provide a warmer refrigerant stream;

(b) withdrawing the warmer refrigerant stream from the heat exchanger at an intermediate exit port between the entry port and the warmer exit port;

(c) passing the warmer refrigerant stream back into the heat exchanger through a second entry port located in a second zone of the heat exchanger, the second zone of the heat exchanger being warmer than the first zone;

(d) providing a single mixed refrigerant (SMR) in an SMR recirculating system, the system comprising at least the steps of:

(1) compressing the SMR using at least one oil-injected screw compressor to provide a post-compression SMR stream, (2) separating the post-compression SMR stream to provide an oil-based stream and a first SMR vapour stream, (3) passing the first SMR vapour stream into the heat exchanger to cool the first SMR vapour stream and provide a cooled first SMR vapour stream, (4) withdrawing the cooled first SMR vapour stream from the heat exchanger, (5) separating the cooled first SMR vapour stream to provide an oil-containing liquid-phase SMR stream and an oil-free SMR vapour stream, and (6) passing the oil-free SMR vapour stream through the heat exchanger to provide a condensed SMR stream;

(e) expanding the condensed SMR stream to provide an expanded lowest temperature SMR stream serving as the first refrigerant for heat exchange against the BOG stream;

(f) passing the expanded lowest temperature SMR stream through the heat exchanger to provide the warmer SMR stream;

(g) expanding the oil-containing liquid-phase SMR stream of step (5) to provide an at least partially expanded oil-containing refrigerant stream;

(h) passing the at least partially expanded oil-containing refrigerant stream into the heat exchanger through a third entry port located in a second zone of the heat exchanger;

(i) combining the warmer SMR stream from step (c) with the at least partially expanded oil-containing refrigerant stream from step (g) in the second zone of the heat exchanger to provide a combined refrigerant stream; and (j) passing the combined refrigerant stream out of the heat exchanger through the warmer exit port.

2. The method as claimed in claim 1 wherein the BOG stream is from a liquefied cargo tank in a floating vessel.

3. The method as claimed in claim 2 wherein the BOG stream is a liquefied natural gas (LNG) from the liquified cargo tank.

4. The method as claimed in claim 1 wherein the oil-containing refrigerant comprises a single mixed refrigerant (SMR).

5. The method as in claim 1 wherein the heat exchanger is a single liquefaction heat exchanger in a BOG liquefaction heat exchanger system.

6. The method as claimed in claim 1 wherein the heat exchanger is a liquefaction heat exchanger system comprising a multi-unit liquefaction heat exchange and two or more heat exchanger units, and the BOG stream and the first refrigerant pass through at least a coldest of the two or more heat exchanger units.

7. The method as claimed in claim 1 wherein the heat exchanger is a vertical or near vertical heat exchanger.

8. The method as claimed in claim 7 wherein the heat exchanger comprises a plate-fin heat exchanger or a printed circuit heat exchanger.

9. The method as claimed in claim 1 wherein the oil in the oil-containing refrigerant stream comprises compressor lubricating oil.

10. The method as claimed in claim 1 further comprising the step of expanding the first refrigerant prior to step (a).

11. The method as claimed claim 1 wherein the temperature in the heat exchanger at the combining step (i) is higher than the temperature of the first zone in the heat exchanger.

12. The method as claimed in claim 1 wherein the intermediate exit port is within the second zone of the heat exchanger.

13. The method as claimed in claim 1 wherein the temperature of the second zone is warmer than the freezing temperature of the oil of the oil-containing refrigerant.

14. An apparatus for cooling a boil-off gas (BOG) stream from a liquefied gas tank comprising:

a heat exchanger for receiving the BOG stream and having an entry port and a warmer exit port, the heat exchanger further comprising a first refrigerant directed into the entry port and into a first zone within the heat exchanger to exchange heat with the BOG stream and to provide a warmer refrigerant stream;

an intermediate exit port between the entry port and the warmer exit port, the warmer refrigerant stream directed through the intermediate exit port and out of the heat exchanger;

a second entry port located in a second zone of the heat exchanger, the second zone of the heat exchanger being warmer than the first zone, and directing the warmer refrigerant stream through the second entry port and into the heat exchanger; and a single mixed refrigerant (SMR) recirculating system having (1) at least one oil-injected screw compressor for compressing the SMR using to provide a post-compression SMR stream, (2) a separator for separating the post-compression SMR stream to provide an oil-based stream and a first SMR vapour stream, (3) directing the first SMR vapour stream into the heat exchanger to cool the first SMR vapour stream and provide a cooled first SMR vapour stream, and withdrawing the cooled first SMR vapour stream from the heat exchanger, (4) a separator for separating the cooled first SMR vapour stream to provide an oil-containing liquid-phase SMR stream and an oil-free SMR vapour stream, and (5) directing the oil-free SMR vapour stream through the heat exchanger to provide a condensed SMR stream;

withdrawing the condensed SMR stream from the heat exchanger;

a pressure reducing device for expanding the condensed SMR stream to provide an expanded lowest temperature SMR stream, the expanded lowest temperature SMR stream forming the first refrigerant for the heat exchanger;

a further pressure reducing device for expanding the oil-containing liquid-phase SMR stream to provide an at least partially expanded oil-containing refrigerant stream;

directing the expanded lowest temperature SMR stream through the heat exchanger for heat exchange against the BOG stream to provide the warmer SMR stream;

directing the at least partially expanded oil-containing refrigerant stream into the heat exchanger through a third entry port located in the second zone of the heat exchanger;

combining the warmer SMR stream, directed into the heat exchanger through the second entry port, with the oil-containing refrigerant stream, directed into the heat exchanger through the third entry port, within the heat exchanger to provide a combined refrigerant stream; and directing the combined refrigerant stream out of the heat exchanger through the warmer exit port.

* * * * *